US012808066B2

(12) United States Patent
Latsuzbaia et al.

(10) Patent No.: US 12,808,066 B2
(45) Date of Patent: Nov. 24, 2026

(54) HEAT INTEGRATED ELECTROCHEMICAL CONVERSION

(71) Applicant: Nederlandse Organisatie voor toegepast-natuurwetenschappelijk onderzoek TNO, The Hague (NL)

(72) Inventors: Roman Latsuzbaia, Delft (NL); Earl Lawrence Vincent Goetheer, Mol (BE); Carlos Sánchez Martínez, Delft (NL)

(73) Assignee: NEDERLANDSE ORGANISATIE VOOR TOEGEPAST-NATUURWETENSCHAPPELIJK ONDERZOEK TNO, 'S-Gravenhage (NL)

( * ) Notice: Subject to any disclaimer, the term of this patent is extended or adjusted under 35 U.S.C. 154(b) by 99 days.

(21) Appl. No.: 18/553,980

(22) PCT Filed: Apr. 6, 2022

(86) PCT No.: PCT/NL2022/050191
§ 371 (c)(1),
(2) Date: Oct. 4, 2023

(87) PCT Pub. No.: WO2022/216153
PCT Pub. Date: Oct. 13, 2022

(65) Prior Publication Data

US 2024/0183043 A1 Jun. 6, 2024

(30) Foreign Application Priority Data

Apr. 6, 2021 (EP) ..... 21166915

(51) Int. Cl.
*C25B 3/26* (2021.01)
*C25B 9/19* (2021.01)
(Continued)

(52) U.S. Cl.
CPC ..... *C25B 3/26* (2021.01); *C25B 9/19* (2021.01); *C25B 9/67* (2021.01); *C25B 15/08* (2013.01)

(58) Field of Classification Search
None
See application file for complete search history.

(56) References Cited

U.S. PATENT DOCUMENTS

2013/0008800 A1* 1/2013 Lakkaraju ..... C25B 3/25 204/242

FOREIGN PATENT DOCUMENTS

EP 3527695 A1 8/2019
EP 3536823 A1 9/2019
(Continued)

OTHER PUBLICATIONS

International Search Report issued in PCT/NL2022/050191 on Jul. 18, 2022.

*Primary Examiner* — Wojciech Haske
(74) *Attorney, Agent, or Firm* — Blank Rome LLP

(57) ABSTRACT

The invention relates to a heat integrated electrochemical process for converting a gas, such as carbon dioxide, using, for example, an electrochemical reactor. The process comprises a) feeding a gas-containing absorbent into an electrochemical cell;
b) releasing a gas from the gas-containing absorbent by using thermal energy, wherein at least part of the thermal energy originates from Joule heat generated by the electrochemical cell, and
c) converting the released gas to form a product.

8 Claims, 4 Drawing Sheets

(51) Int. Cl.
*C25B 9/67* (2021.01)
*C25B 15/08* (2006.01)

(56) References Cited

FOREIGN PATENT DOCUMENTS

| | | | |
|---|---|---|---|
| WO | 2003077342 | A2 | 9/2003 |
| WO | 2007041872 | A1 | 4/2007 |
| WO | 2013006710 | A2 | 1/2013 |
| WO | 2019160413 | A1 | 8/2019 |

* cited by examiner

HEAT INTEGRATED ELECTROCHEMICAL CONVERSION

CROSS-REFERENCE TO RELATED APPLICATIONS

This application is the U.S. national stage of International Patent Application No. PCT/NL2022/050191, filed Apr. 6, 2022, which claims priority to European Application No. 21166915.5 filed Apr. 6, 2021.

FIELD OF THE INVENTION

The invention relates to the field of electrochemistry. In general, the invention relates to electrochemical conversion processes, wherein capture solvents are used. The invention also relates to electrochemical cells and bipolar plates for heat integrated electrochemical conversion. More in particular, the invention relates to a heat integrated electrochemical process, especially encompassing electrochemical reduction of, for example, carbon dioxide.

BACKGROUND OF THE INVENTION

Electrochemical conversion of reactant gases, such as carbon dioxide, to their conversion products, for example, formic acid or carbon monoxide in the case of carbon dioxide, is known. Such conversion is achieved using electrolysers that typically consist of an anode compartment and a cathode compartment both separated from each other by an ion exchange membrane, for example, a proton exchange membrane. Depending on what is converted, the electrochemical conversion takes places at the anode or cathode. In the case of carbon dioxide, its conversion is typically conducted at in the cathode compartment of electrolysers.

The cathode compartment of electrolysers typically comprises a cathode electrode, such as a gas diffusion electrode comprising a catalyst layer and a gas diffusion layer, catholyte on one side of the cathode and a current collector, such as a bipolar plate, at the other side of the cathode. Electrolysers for conversion of gaseous reactants are known wherein either a gas stream containing a reactant gas, or a solvent or an absorbent comprising a captured reactant gas is fed into. Those of the latter type need to release the captured reactant gas from the absorbent for the electrochemical reaction. A reactant gas-rich absorbent often is not electrically conductive by itself. Hence, processes known in the art require the absorbent to become electrically conductive, which is achieved by, for example, the addition of supporting electrolytes. However, such a measure compromises properties of the absorbent. Alternatively, ionically conductive absorbents exist, however, the typical reaction performance of electrochemical conversion of carbon dioxide is poorer than in water supporting electrolytes. Accordingly, it is important to provide efficient capture and release of reactant gas without compromising properties of the capture medium.

Several studies focus on optimising the electroreduction of reactant gases, such as carbon dioxide.

For example, WO-A-2007/041872 describes an electrochemical process for reducing carbon dioxide, wherein a liquid catholyte containing dissolved carbon dioxide is directly fed into a cathode compartment. The pressure and the temperature of the cathode compartment are elevated to improve current efficiencies. An electric current is applied that heats the anolyte. The anolyte is heated further with Joule heat. The heated anolyte is used to heat recycling catholyte to separate the conversion product from the catholyte. The energy efficiency of such a process can be improved.

EP-A-3 536 823 describes an electrochemical process for converting carbon dioxide, wherein the conversion reaction is performed in the same compartment where the carbon dioxide is desorbed from an absorbent. The local release of the carbon dioxide from the absorbent can be induced by heating the anode and cathode. It is not mentioned where the energy for heating both electrodes comes from.

Other studies focus on improving the efficiency of electrochemical processes by redesigning electrochemical cells.

WO-A-03/077342, for example, describes a bipolar plate for a fuel cell, which provides for venting anode effluent gas. Thereto, the bipolar plate has a gaseous effluent vent channel positioned on its anode side. Such a bipolar plate is not suitable for liquid absorbents containing reactant gas.

WO-A-2013/006710 describes an integrated electrochemical capture and conversion of carbon dioxide process, wherein the capture solvent is an ionic liquid and is used as the electrolyte.

WO-A-2019/160413 describes an integrated electrochemical capture and conversion of carbon dioxide process, wherein the capture solvent is used as the electrolyte for electrolysis. Typically, capture solvents are less suitable as electrolytes.

There remains a need in the art for an electrochemical process that provides high energy efficiency. Hence, it is an objective of the invention to address this need in the art. Another objective of the invention is to provide an electrochemical process that efficiently releases reactant gas from an absorbent while maintaining good electrical conductivity and reaction conditions throughout the electrochemical cell. Another objective of the invention is to reduce the amount of heat lost as waste heat and utilise it in the process. Another objective of the invention is to provide an electrochemical process that is cost-effective. Another objective of the invention is to improve the energy efficiency of releasing reactant gas from an absorbent.

SUMMARY OF THE INVENTION

The inventors surprisingly found that one or more of these objectives can, at least in part, be met by releasing a reactant gas from an absorbent by using thermal energy coming at least in part from heat generated during an electrochemical process.

Accordingly, in a first aspect, the invention is directed to a process of electrochemically converting a gas, for example, carbon dioxide, in an electrochemical cell, comprising:

a) feeding a gas-containing absorbent into an electrochemical cell;

b) releasing a gas from the gas-containing absorbent by using thermal energy, wherein at least part of the thermal energy originates from Joule heat generated by the electrochemical cell, and c) converting the released gas to form a product.

The electrochemical process can be an electrochemical process for reducing a gas, such as carbon dioxide. Compared to known electrochemical processes, the invention takes a new and innovative approach to improve the energy efficiency of electrochemical conversion processes that use gas-liquid mixtures to supply a reactant gas, while maintaining good electrical conductivity. With the electrochemical process, an absorbent stream containing a reactant gas is fed into an electrochemical cell. Hence, the process comprises a step of feeding a gas-containing absorbent into an electrochemical cell. The invention further provides the advantage of integrated stripping of a reactant gas from an absorbent and conversion of the stripped gas.

DETAILED DESCRIPTION OF THE INVENTION

Figure 1:
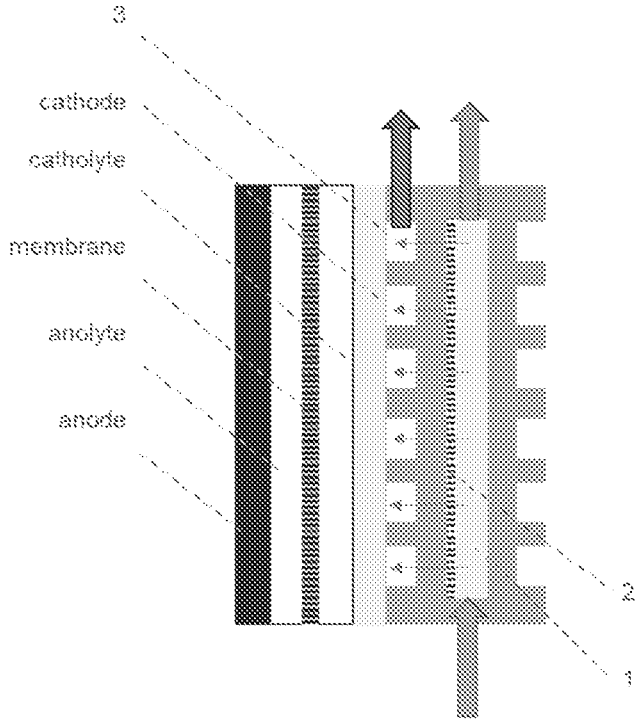
FIGS. 1-6 depict membrane electrode assembly configurations.

The gas-containing absorbent that is fed into the electrochemical cell can be supplied at a temperature of, for example, 20-25° C. The gas-containing absorbent can be preheated before being fed into the electrochemical cell if, for example, the heat generated by the electrochemical cell is insufficient to raise the temperature of the absorbent to release the gas from the gas-containing absorbent. The preheating can include raising the temperature of the gas-containing absorbent to, for example, 20-60° C., such as 30-50° C.

The gas-containing absorbent can be formed by contacting a gas stream containing a reactant gas with an absorbent, thereby absorbing at least part of the reactant gas from the gas stream. The gas is a gaseous reactant for electrochemical conversion. The reactant gas can comprise, or can be, for example, carbon monoxide and/or carbon dioxide. The gas preferably comprises, or is, carbon dioxide.

Contact between the reactant gas-containing gas stream and the absorbent can be achieved by imposing a flow or feed of the reactant gas-containing gas stream through a connector, such as piping, to a unit, such as a compartment or vessel comprising the absorbent. Preferably, all of the gas-containing absorbent is introduced into the electrochemical cell as this can positively affect the economic viability of the electrochemical process. Part, or all, of the gas-containing absorbent can be formed by contacting the reactant gas-containing gas stream with an absorbent in an absorber unit. Ideally, the use of an absorber unit to provide for the gas-containing absorbent can be integrated in the electrochemical process. Hence, the electrochemical process can comprise a step of absorbing a gas, as described in this disclosure, with an absorbent as described in this disclosure, thereby forming the gas-containing absorbent.

The reactant gas-containing gas stream can be obtained from a pre-combustion process, combustion exhaust gas or flue gas of a combustion process, from a natural gas stream, from synthesis gas, from a carbon dioxide exhaust of, for example, a fermentative ethanol production plant, and/or any other carbon dioxide-containing source. Suitable examples of combustion processes include steam methane reforming (SMR), blast furnaces, and air-fired or oxygen-enhanced fossil fuel combustion processes, such as power plants.

The reactant gas-containing gas stream can comprise 3-90% of reactant gas by total volume of the reactant gas-containing gas stream, such as 10-85%, 15-75%, or 20-70%. Preferably, the reactant gas-containing gas stream comprises 4-85 vol. % reactant gas. Other components that can be contained within the reactant gas-containing gas stream include, for example, other combustion by-products, such as water, methane, nitrogen, oxygen, argon, carbon monoxide, sulphur oxides, hydrogen sulphide, and nitrogen oxides.

The reactant gas-containing gas stream can be treated to remove contaminants or impurities that would negatively affect the electrochemical process. Suitable treatments can include molecular sieving through adsorption and/or absorption mechanisms, scrubbing, and non-thermal plasma treatment. Furthermore, moisture or water can be present in the reactant gas-containing gas stream.

Depending on the source of the reactant gas-containing gas stream and type of absorbent the gas stream may require compression, for example, by means of one or more compressors, to achieve, for example, an absolute pressure from 1-200 bar. The initial absolute pressure of the reactant gas-containing gas stream can be maintained throughout step a) or steps a) and b) of the electrochemical process. As a possible result, no (additional) pressure swing adsorption units are required.

The gas-containing absorbent can be introduced next to a cathode compartment or an anode compartment of an electrochemical cell. In particular, the gas-containing absorbent can be introduced to a compartment, such as a flow compartment, for example, comprising a flow channel. The compartment, and/or the flow channel, are capable of transporting gas-containing absorbent(s). The flow channel can comprise, or be, a serpentine flow channel. The gas in the gas-containing absorbent can be released from the gas-containing absorbent inside the compartment, such as inside the flow channel. There can be a continuous flow of gas-containing absorbent through the compartment, resulting in continuous supply of gas for electrochemical conversion. The released gas can diffuse from inside the compartment to outside the compartment, such as outside the flow channel. The released gas can diffuse through a gas permeable layer to a cathode compartment or to an anode compartment. In the cases of, for example, the released gas being carbon dioxide or comprising carbon dioxide, the released gas can diffuse through the gas permeable layer to a cathode compartment where it can react to produce carbon dioxide conversion products, such as those mentioned in this disclosure. The cathode compartment, as described in this disclosure, can comprise a cathode, and may further include a catholyte. The gas permeable layer can be attached to the cathode. For example, the gas permeable layer can be integrated into the cathode.

The gas permeable layer can be located between the gas-containing absorbent inside the compartment and a cathode compartment. The gas permeable layer can be located inside the flow channel, for example, on a cathode side of the compartment. FIG. 1 schematically shows an example of such a configuration. The gas released from the gas-containing absorbent inside the flow channel 1 can diffuse through the gas permeable layer 2 on a cathode side of the compartment in a direction towards the cathode compartment. A gas compartment 3 can be present between the cathode compartment and the compartment comprising the flow channel. Accordingly, the diffused gas that leaves the flow channel can enter the gas compartment. The gas compartment can comprise a serpentine flow-field. The diffused gas can then react at the cathode, thereby forming conversion products which can be collected from the gas compartment. Whereas in FIG. 1 a catholyte separates the cathode from the central membrane, configurations are possible where the cathode is in direct contact with the central membrane. Such a configuration is schematically shown in FIG. 2.

Figure 2:
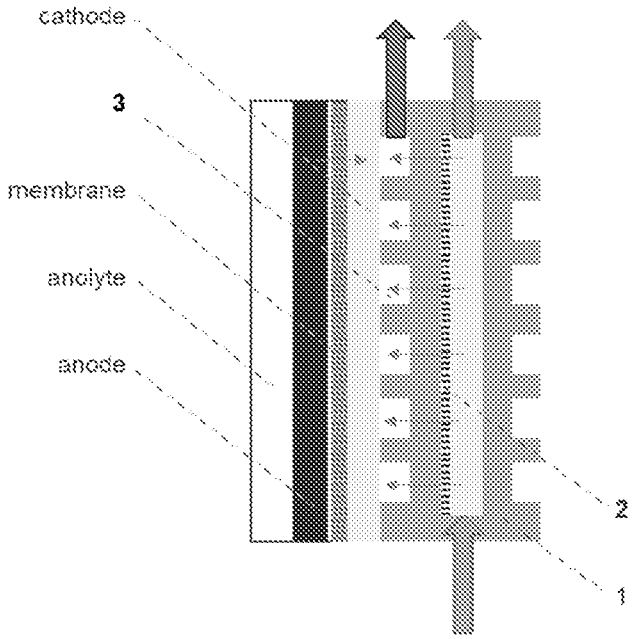

FIG. 2 depicts a membrane electrode assembly (MEA) configuration. MEA configurations are preferred with the invention. Advantages of such configurations include lower ohmic losses and minimised losses of reactant gas to catholyte and anolyte. The gas permeable layer 2 is located inside the compartment 1 on a cathode side. Just as with the configuration depicted in FIG. 1, the gas compartment 3 can be present with the MEA configurations. The gas permeable layer can be located on an external cathode side of the compartment comprising the flow channel, i.e., adjacent to an external cathode side of the compartment.

Figure 3:
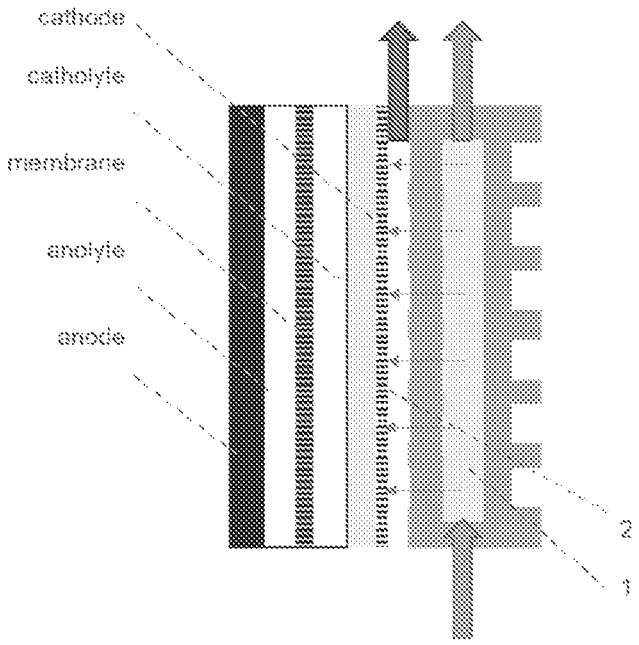

FIG. 3 schematically shows an example of such a configuration. In that case, the gas permeable layer 2 is not located inside the flow channel 1, but, for example, between the compartment and an electrode, such as the anode or cathode. The aforementioned gas compartment may or may not be present when the gas permeable layer, such as a gas diffusion electrode, is located on an external side of the compartment comprising the flow channel.

Figure 4:
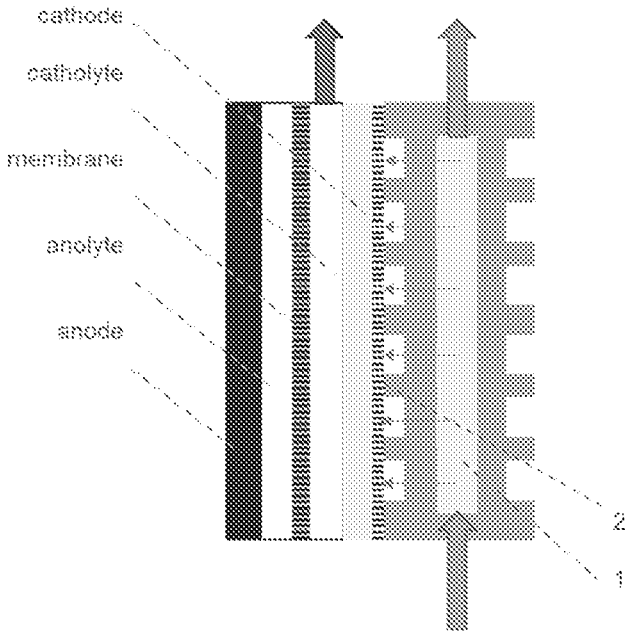

FIG. 4 schematically shows an example of a configuration wherein the gas permeable layer 2 is in contact with the cathode. The layer can be part of the cathode. The gas permeable layer acts as a separator between catholyte on one side of the cathode and liquid absorbent of the gas-containing absorbent in the compartment 1. The configuration is suitable for producing, for example, formic acid from carbon dioxide. The catholyte, which can be aqueous, can be used to collect and extract conversion products of, for example, carbon dioxide, such as formic acid or salts thereof.

Figure 5:
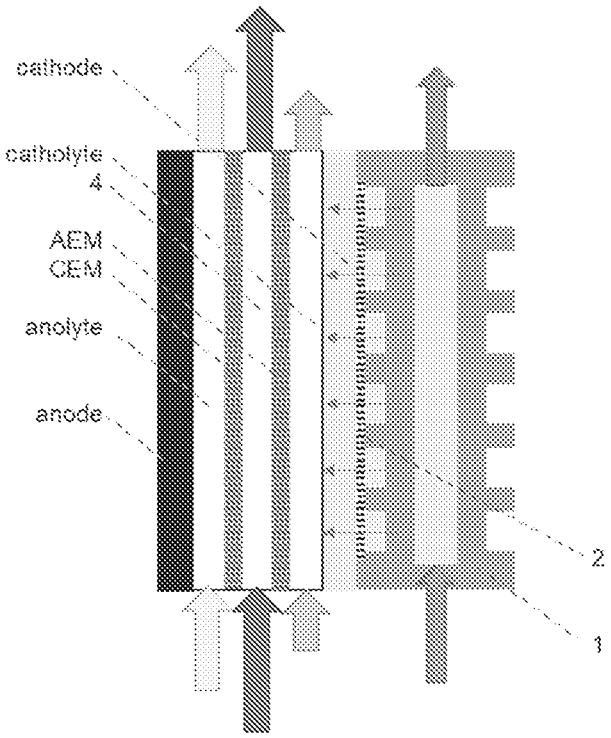

FIG. 5 schematically shows an example of a configuration having an additional compartment 4 compared to the configuration of FIG. 4. The additional compartment is between the anode and the cathode, in particular between a cathode exchange membrane (CEM) and an anode exchange membrane (AEM). The gas permeable layer 2 acts as a separator between catholyte on one side of the cathode and liquid absorbent of the gas-containing absorbent in the compartment 1. The catholyte can be used to collect and optionally extract conversion products of, for example, carbon dioxide, particularly salts. The additional compartment can comprise a solvent flow, which can be aqueous, to collect and extract conversion products, such as formic acid when carbon dioxide is electrochemically reduced. In a preferred alternative configuration, the CEM is in direct contact with the anode.

Figure 6:
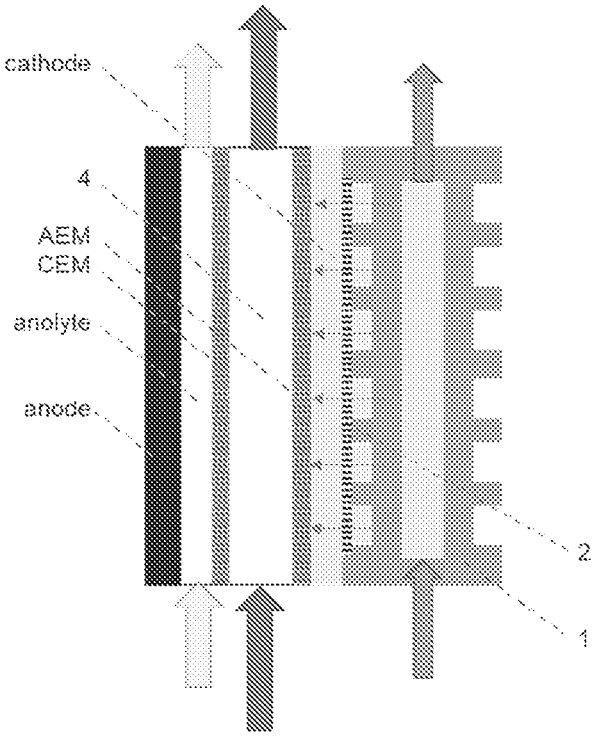

Just as FIG. 5, FIG. 6 schematically shows an example of a configuration having an additional compartment 4. A difference, however, is that the configuration in FIG. 6 does not have a catholyte. The AEM is in direct contact with the cathode. The gas permeable layer 2 is in direct contact with the cathode as well. In a preferred alternative configuration, the CEM is in direct contact with the anode.

According to another configuration, the compartment comprises a lower side where the gas-containing absorbent is heated and an upper side where the released gas reacts with the cathode. Such a configuration is tilted. In operation, the gas-containing absorbent enters the compartment. The absorbent is heated on the lower side of the compartment, thereby releasing gas. The released gas moves upwards towards the cathode at the upper side of the compartment where it reacts. Compared to the other configurations, the gas permeable layer does not have to be present.

The gas permeable layer may be considered a membrane with a dense structure that can be porous or non-porous. A non-porous membrane presents no detectable pore at the limits of electron microscopy. The membrane preferably separates gas from the liquid absorbent. A mixture of molecules can be transported through such membranes by diffusion mechanisms under the driving force of a partial pressure gradient of the gas reactant across the membrane.

The gas permeable layer is permeable to a gas. That gas can be any gas to be electrochemically converted, preferably a gas described in this disclosure. In particular, the gas permeable layer can be permeable to carbon dioxide.

The gas permeable layer can comprise a non-porous, gas permeable layer. Non-porous means essentially impermeable to liquids, such as water and absorbents. In particular, the non-porous layer can have a porosity of 10% or less, preferably 5% or less, such as 2% or less, or 1% or less.

The non-porous, gas permeable layer can be a non-porous, gas permeable polymeric layer. The layer can be permeable to carbon monoxide and/or carbon dioxide. The layer is preferably permeable to carbon dioxide. The layer can comprise one or more materials selected from the group consisting of polyorganosilicons (such as poly(1-(trimethylsilyl)-1-propyne (PTMSP)), polysiloxanes (such as polydimethylsiloxane (PDMS)), polysilanes (such as poly (vinyltrimethylsilane) (PVTMS)), polyolefins (such as polymethylpentene (PMP) and poly(ethylene glycol) (PEG)), aromatic polymers (such as poly(p-phenylene oxide) (PPO) and polysulphones), polyacrylonitrile (PAN), polypropylene hollow fibres (Oxiphan), polyvinyl amines (PVAm), polyvinyl alcohol (PVA), polyethyleneimines (PEI), and the like. Preferably, the non-porous layer comprises one or more selected from the group consisting of PTMSP, PDMS, PVTMS, PMP and PPO.

The gas permeable layer can comprise a porous layer. Porous refers to the presence of voids throughout the internal structure of a material that form an interconnected continuous path from one surface to another. In particular, the porous layer can have a porosity in the range of 10-95%, such as 20-90%, 30-80%, 40-75%, or 50-70%. Porosity is a measure of void spaces in a material and is typically a fraction of the volume of voids over the total volume. The porous layer can be permeable to fluid, particularly gases. The porous layer allows gas to pass through. The porous layer can be a porous polymeric layer, for example, made from polytetrafluoroethylene. The porous polymeric layer can comprise one or more polymers selected from the group consisting of halogenated polymers, polyorganosilicons, polysiloxanes, polysilanes, polyolefins, aromatic polymers, polyacrylonitrile, polyvinyl amines, and polyvinyl alcohol. The porous layer can be a porous metallic layer, a porous ceramic layer or a combination of both. Optionally, the porous metallic layer comprises a hydrophobic layer. The hydrophobic layer comprises a liquid-repellent material. While being permeable to gas, the hydrophobic layer is impermeable to liquids, such as aqueous and non-aqueous liquids, including absorbents.

The gas-containing absorbent can be stripped from its gas by, for example, elevating the temperature and/or lowering the pressure. This typically depends on the type, or types, of absorbent(s) used. The absorbent is a fluid, preferably a liquid.

For example, the absorbent can comprise, or be, a physical solvent or a mixture of physical solvents, a chemical solvent or a mixture of chemical solvents, or a mixture of one or more physical solvents and one or more chemical solvents (i.e., hybrid system). It may be advantageous to use a mixture of one or more physical solvents and one or more chemical solvents.

The physical solvent(s) can be selected from the group consisting of, for example, Selexol™, Rectisol™, Sulfinol®, Amisol®, Genosorb®, (various) dimethyl ethers of polyethylene glycol, N-methyl-2-pyrrolidone, methanol, ethanol, alkylene carbonates such as propylene carbonate, acetone, sulpholane, dimethylsulphoxide, tetrahydrofuran, dimethylformamide, N-methyl-2-pyrrolidone, hexamethylphosphoramide, acetonitrile, water, dichloromethane, propylene carbonate, pyridine, and hexafluoro-2-propanol. In the case where the gas-containing absorbent comprises carbon dioxide and a physical solvent, the physical solvent preferably comprises a dimethyl ether of polyethylene glycol as its carbon dioxide absorption capacity is relatively high at elevated absolute pressure and temperature. The absolute pressure of the gas-containing absorbent comprising a physical solvent can be from 1 bar up to and including 200 bar. Preferably, the absolute pressure is 5 bar or more, 10 bar or more, 20 bar or more, 30 bar or more, 40 bar or more, or 50 bar or more, and/or 180 bar or less, 160 bar or less, 140 bar or less, 120 bar or less, or 100 bar or less. An advantage of using a physical solvent at a given absolute pressure is that it requires less heat to release the reactant gas from the gas-containing absorbent compared to when a chemical solvent is used.

The chemical solvent can comprise a chemical compound with at least one amine functional group with or without a hydroxyl functional group, for example, of the type of alkanolamine. Low volatility solvents, such as solvents having a boiling point of 100° C. or more at 1 atm pressure, are preferred. The chemical solvent(s) can be selected from the group consisting of monoethanolamine, diethanolamine, N-methyldiethanolamine, dimethylethanolamine, diisopropanolamine, aminomethylpropanol, ammonia, and diglycolamine. In the case where the gas-containing absorbent comprises carbon dioxide and a chemical solvent, the chemical solvent preferably comprises monoethanolamine, as monoethanolamine is has a relatively high carbon dioxide absorption capacity and favourable absorption kinetics. The absolute pressure of the gas-containing absorbent comprising a chemical solvent can be from 1 bar up to and including 50 bar. Preferably, the absolute pressure is 50 bar or less, and/or 1 bar or more, 2 bar or more, 3 bar or more, 4 bar or more, 5 bar or more, 10 bar or more, 20 bar or more, 30 bar or more, or 40 bar or more.

The gas-containing absorbent can be aqueous, for example, comprising an aqueous monoethanolamine mixture, such as about 30 wt. % aqueous monoethanolamine, or non-aqueous.

Unlike with known electrochemical processes, the gas-containing absorbent may contain contaminants and other impurities, preferably as long as the to be converted separated gas is substantially free of contaminants and other impurities. This provides a surprising advantage of the process as described in this disclosure over known processes.

The gas is released from the gas-containing absorbent through heating the gas-containing absorbent using thermal energy. The thermal energy can originate in part, or entirely, from heat generated with the electrochemical process, for example, by electrochemical reactions, from heat produced by the electrochemical cell, for example, by current conducting parts of the electrochemical cell (i.e., Joule heat, which is also known as Ohmic heat or electroconductive heat), ohmic losses due to ionic resistance of the electrolyte(s) used in the electrochemical cell, etc. In particular, at least part of the thermal energy originates from heat generated by the electrochemical cell. The thermal energy can originate in part from, for example, a source that can generate heat and is external to the electrochemical cell. The thermal energy can originate in part from the aforementioned heat source and in part from heat generated with the electrochemical process, such as by current conducting parts of the electrochemical cell. The inventors surprisingly found that the overall energy efficiency of the electrochemical process can be improved by collecting generated heat, particularly Joule heat, and transferring the thermal energy to the gas-containing absorbent. Preferably, at least part of the thermal energy comes from Joule heat. The heat is transferred to the compartment, as described in this disclosure, where the gas-containing absorbent is fed into. The heat transfer primarily happens through conduction and convention, while less so by radiation.

The driving force behind the release of the reactant gas from the gas-containing absorbent is the pressure difference between the gas-containing absorbent in the compartment and the partial pressure of reactant gas in the vapour phase. Upon increasing the temperature, the vapour pressure increases, and the reactant gas gets released and is transported (permeates) through the gas permeable layer. The release rate of the reactant gas from the gas-containing absorbent can be controlled with the flow rate of the gas-containing absorbent and its temperature.

The temperature in the compartment, optionally comprising the flow channel, can be −10° C. or more and/or 95° C. or less. A temperature below 0° C. can adversely affect the release of the reactant gas. In addition, the low temperature range may be limited by the absorbent and its freezing point. In particular, the temperature can be 5° C. or more, and/or 70° C. or less, 60° C. or less, 50° C. or less, 40° C. or less, 30° C. or less, 20° C. or less, or 10° C. or less. When the temperature is more than 70° C., the partial pressure of the reactant gas in the vapour phase may increase significantly because of reduced solubility. One or more (external) heat exchangers can be used to control the temperature in case of a too low temperature.

A gas-poor absorbent (viz. lean absorbent) may be provided after the release of the reactant gas from the gas-rich absorbent (viz. rich absorbent). The lean absorbent has a reactant gas content of 50% or less, based on the total volume of the lean absorbent. A reactant gas content of more than 50 vol. % can adversely affect the cost and energy efficiency of the electrochemical process. In addition, a reactant gas content of more than 50 vol. % can be the result of one or more deficiencies occurring during the process. The preferred reactant gas content of the lean absorbent is 40 vol. % or less, 30 vol. % or less, 25 vol. % or less, 20 vol. % or less, 15 vol. % or less, 10 vol. % or less, 8 vol. % or less, 5 vol. % or less, or 2 vol. % or less. Preferably, the reactant gas content of the lean absorbent is 10 vol. % or less.

The lean absorbent can optionally be recirculated to further absorb a reactant gas and/or to be fed into the electrochemical cell for releasing remaining reactant gas. Recirculated lean absorbent can be brought into contact with a reactant gas-containing gas stream and/or a rich absorbent. The recirculated lean absorbent can uptake reactant gas and become rich absorbent.

The electrochemical cell can comprise a bipolar plate. The compartment, optionally comprising a flow channel as described in this disclosure, can be between the bipolar plate and another compartment of the electrochemical cell, such as the anode compartment or cathode compartment, preferably the cathode compartment. The rich absorbent can be introduced into the bipolar plate. The bipolar plate can include the compartment that optionally comprises a flow channel, as described in this disclosure, which can be considered a flow compartment. Hence, the rich absorbent can be introduced into the compartment of a bipolar plate, wherein the rich absorbent is stripped from reactant gas. The bipolar plate is designed such that thermal energy can be efficiently transferred to its compartment, thereby raising the temperature of any rich absorbent passing through the compartment, for example, through the flow channel. The bipolar plate can have externally, for example, on a cathode side, one or more channels suitable for gas flow, and/or on an anode side one or more channels suitable for a liquid flow, such as a water flow when, for example, water is anodically oxidised to oxygen.

The bipolar plate can be made from one or more materials selected from the group consisting of polymers, metals, including alloys, carbon, including graphite, and composites thereof, such as carbon/polymer composites. The materials can be coated to provide protection, for example, corrosion resistance, for the material under reaction conditions. The one or more materials can be selected from the group consisting of molybdenum, tungsten, niobium, tantalum, titanium, stainless steel, platinum, and graphite. Hence, the bipolar plate can be metal-based, such as titanium-based, stainless steel-based or platinum-based, or carbon-based, for example, graphite-based. The bipolar plate can comprise electrically conductive and/or corrosion resistant material. It is important for the material(s) to provide sufficient thermal conductivity such that thermal energy can be efficiently used to heat the compartment of the bipolar plate comprising the flow channel. The bipolar plate can be made of one or more metals having a thermal conductivity at 20° C. of at least 10 $W \cdot m^{-1} \cdot K^{-1}$. The thermal conductivity at 20° C. can be 15 $W \cdot m^{-1} \cdot K^{-1}$ or more, such as 20-200 $W \cdot m^{-1} \cdot K^{-1}$, or 50-150 $W \cdot m^{-1} \cdot K^{-1}$. Preferably, the thermal conductivity at 20° C. is 25-100 $W \cdot m^{-1} \cdot K^{-1}$. The bipolar plate can be carbon-based, in particular graphite-based, as it has a lower electrical conductivity when compared to metal-based, which will result higher levels of thermal energy collected.

The electrochemical process further comprises a step of converting the released gas to form a product. The gas can be electrochemically converted to valuable chemical compounds. In particular, the step of converting the released gas is performed in the electrochemical cell. In case the gas comprises carbon dioxide, this carbon dioxide can be converted into compounds such as alkanes, alkenes, carbon monoxide, carboxylic acids, alcohols, aldehydes, and/or ketones. More specifically, the carbon dioxide can be converted into carbon monoxide, methane, methanol, ethane, ethene, ethanol, formic acid, oxalic acid, glyoxylic acid, glycolic acid, acetic acid, tartaric acid, malonic acid, propionic acid, acetaldehyde, and/or salts thereof.

The electrochemical process can be operated in batch, semi-continuously or continuously. Batch processing has a lower risk of failure and is characterised by long reaction times, yet, lower production rates are a result. Continuous processing may be more efficient and lucrative, as products can be obtained in significantly larger amounts and require lower operating costs.

Figure 7:
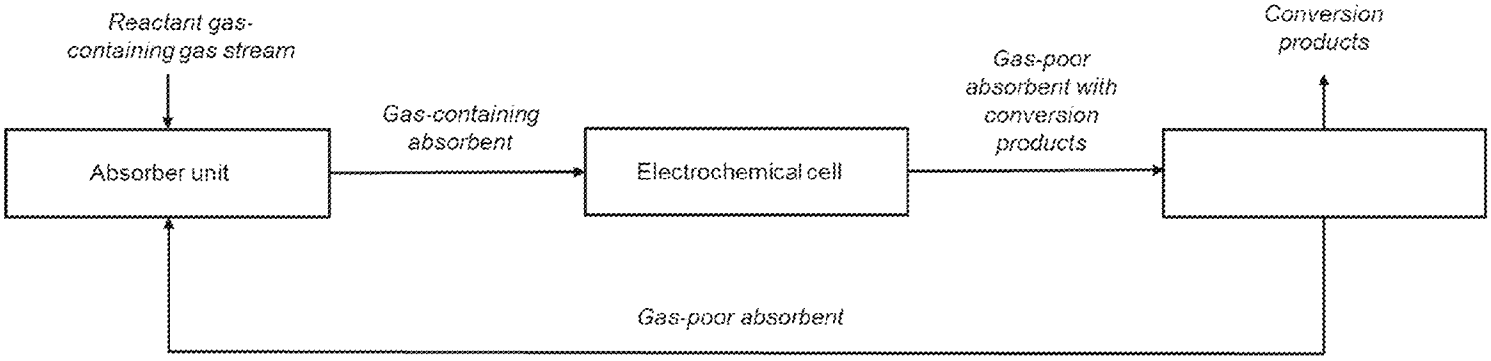
FIG. 7 is a flowchart of an electrochemical process.

The electrochemical process can be schematically illustrated in detail in the flowchart of FIG. 7.

The bipolar plate can be configured as depicted in any one of FIGS. 1-6. The bipolar plate is preferably for an electrochemical cell.

An apparatus is provided, such as an electrochemical reactor. The apparatus can comprise any configuration as described in this disclosure, such as any configuration as depicted in any one of FIGS. 1-6. The apparatus is preferably for reducing carbon dioxide. In particular, the apparatus can be for performing the process as described in this disclosure.

In another aspect, the invention is directed to an apparatus. Preferably, the apparatus is for performing the process as described in this disclosure. The apparatus may be an electrochemical reactor. The apparatus comprises a compartment, preferably as described in this disclosure, which optionally comprises a flow channel. The apparatus can further comprise a bipolar plate, such as described in this disclosure, wherein the bipolar plate can comprise the compartment. The compartment is arranged to receive a gas-containing absorbent as described in this disclosure, such as a carbon dioxide-containing absorbent. The apparatus further comprises an electrochemical cell connected to the compartment, where the electrochemical cell is arranged to electrochemically reduce carbon dioxide. The electrochemical cell can be as defined in this disclosure. The electrochemical cell is preferably for converting carbon dioxide. The electrochemical cell can be designed in such a way that both an anode compartment and a cathode compartment are present, which can be separated from one another by more than one separator. The separator is preferably a membrane, such as an ion exchange membrane. The separator can comprise a bipolar membrane, an ion exchange membrane, a cation exchange membrane, an anion exchange membrane, a charge-mosaic membrane, or a layered mixture of anion and cation exchange resins. The electrochemical cell can be a three-compartment electrochemical cell. The electrochemical cell can comprise a compartment as described in this disclosure, and optionally comprises a flow channel. The compartment is capable of receiving a gas-containing absorbent as described in this disclosure and conducts electricity and heat. Accordingly, the compartment is capable of collecting thermal energy that can be used to heat up the gas-containing absorbent, thereby stripping the gas-containing absorbent from reactant gas. Hence, the apparatus is arranged to transfer thermal energy, preferably thermal energy from Joule heat as, for example, explained in this disclosure, to the compartment. The bipolar is made of a material, such as a material as described in this disclosure, and can have a thermal conductivity at 20° C. of at least 10 $W \cdot m^{-1} \cdot K^{-1}$. The apparatus further comprises a gas permeable layer, such as the gas permeable layer as described in this disclosure. The gas permeable layer is between the compartment and the electrochemical cell. In particular, the gas permeable layer is between the compartment and a cathode compartment of the electrochemical cell. The gas permeable layer can be part of the compartment. The gas permeable layer can be inside the compartment on a cathode side, for example, on a side of the flow channel or on an external side of the compartment, in particular on a cathode side. The released reactant gas leaves the compartment and passes through the gas permeable layer, as described in this disclosure, and is able to enter either an anode or cathode compartment, preferably a cathode compartment. The compartment is in fluid communication, preferably gas communication, with the electrochemical cell, in particular an anode or cathode compartment, preferably the cathode compartment. In particular, the gas permeable layer is permeable to gas, preferably carbon dioxide, but impermeable to liquid.

The expression "arranged to" is interchangeable with the expression "constructed to" or "configured to". It specifies that part of an apparatus or the entire apparatus is put together in such a way that it is able to perform a certain function, and/or is structurally and mechanically build to withstand certain conditions.

An electrochemical cell is provided. The electrochemical cell can be an electrochemical cell as described in this disclosure. The electrochemical cell comprises a cathode compartment and a bipolar plate as defined in this disclosure. The electrochemical cell can be designed as such that the bipolar plate is in fluid communication, preferably gas communication, with an anode or cathode compartment. In particular, the (flow) compartment of the bipolar plate is in fluid communication, preferably gas communication, with the cathode compartment.

In yet another aspect, the invention is directed to the use of heat generated with an electrochemical conversion of carbon dioxide to promote the release of carbon dioxide from a carbon dioxide-rich absorbent. The conversion of carbon dioxide and the release of carbon dioxide can both be integrated in the same electrochemical process. Hence, the heat can be both generated and used in the same process. The heat can at least in part comprise Joule heat. The carbon dioxide-rich absorbent can comprise a physical solvent and/or a chemical solvent, as described in this disclosure.

The invention has been described by reference to various embodiments, and methods. The skilled person understands that features of various embodiments and methods can be combined with each other.

All references cited herein are hereby completely incorporated by reference to the same extent as if each reference were individually and specifically indicated to be incorporated by reference and were set forth in its entirety herein.

The use of the terms "a" and "an" and "the" and similar referents in the context of describing the invention (especially in the context of the claims) are to be construed to cover both the singular and the plural, unless otherwise indicated herein or clearly contradicted by context. The terms "comprising", "having", "including" and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention. For the purpose of the description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

When referring to a noun in the singular, the plural is meant to be included, or it follows from the context that it should refer to the singular only.

Preferred embodiments of this invention are described herein. Variation of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject-matter recited in the claims appended hereto as permitted by applicable law. Moreover, any combination of the above-described elements in all possible variations thereof is encompassed by the invention unless otherwise indicated herein or otherwise clearly contradicted by context. The claims are to be construed to include alternative embodiments to the extent permitted by the prior art.

For the purpose of clarity and a concise description, features are described herein as part of the same or separate embodiments, however, it will be appreciated that the scope of the invention may include embodiments having combinations of all or some of the features described.

Hereinafter, the invention will be illustrated in more detail by means of specific examples. However, the invention may be embodied in many different forms and should not be construed as being limited to the embodiments set forth herein. Rather, these example embodiments are provided so that this description will be thorough and complete, and will fully convey the scope of the invention to those skilled in the art.

Examples

For a mass transfer-limited process of carbon dioxide capture, stripping and electrochemical conversion, the following calculations on temperature increase by Joule heating were made.

In a system with an electrochemical unit with 1 $m^2$ of total electrode area, a gas-containing absorbent stream comprising carbon dioxide as the absorbed gas, propylene carbonate as a physical solvent, and aminomethyl propanol of 2 mol per litre of solution as chemical solvent, with a total carbon dioxide loading in the gas-containing absorbent stream of 0.35 mol carbon dioxide per mol chemical solvent, the electrochemical process is taken to be mass transfer-limited by the carbon dioxide supply. This electrochemical system features an inlet gas-containing absorbent stream, loaded with carbon dioxide, and catholyte and anolyte liquid streams that flow along the cathode and anode compartments of the cell, respectively, as depicted in FIG. 1. The electrochemical reaction taking place at the cathode is a two-electron exchange reaction for the electrochemical reduction of carbon dioxide in a gas diffusion electrode, preferably in the embodiment depicted in FIG. 1.

Understanding that the electrochemical process is mass transfer-limited by the availability of the carbon dioxide desorbed from the gas-containing absorbent stream that crosses the gas permeable membrane (element 2 in FIG. 1, no mass transfer resistance assumed), assuming a certain energy input to the electrochemical system, and also that heat losses will occur, the necessary carbon dioxide inlet to ensure a certain total current density and Faradaic efficiency of the two-electron exchange carbon dioxide reduction reaction (input parameters), contained in the gas-containing absorbent stream, the flowrate and the temperature increase across the electrochemical unit of said stream can be calculated.

In table 1, a summary of the input parameters of the calculations above are given. Those input parameters refer to the total current density and total cell voltage of the electrochemical system (for a single cell of 1 $m^2$ of total electrode area), the fraction of the input energy that is transformed into Joule heating, the fraction of the latter heat losses that contributes to the heating of the catholyte and anolyte liquid streams, and the Faradaic efficiency of the carbon dioxide electrochemical reduction reaction. For this calculation, carbon monoxide desorption heat was not included.

Table 1. Independent variables to estimate the heat generation and temperature increase of a gas-containing absorbent stream within the electrolyser. "Heat loss" corresponds to the fraction of the total energy input to the electrochemical system in the form of heat losses. "Heat absorbed CAT+AN" is the fraction of heat losses absorbed by the anolyte and catholyte flows. "FE(ERC, 2 $e^-$)" is the Faradaic efficiency for a carbon dioxide reduction reaction involving two electrons.

| Total Current Density [mA · cm$^{-2}$] | Total Cell Voltage [V] | Heat loss [%] | Heat absorbed CAT + AN [%] | FE (ERC, 2 e$^-$) [%] |
|---|---|---|---|---|
| 200 | 3.0 | 10 | 50 | 50 |
| 500 | 4.0 | 25 | 25 | 90 |

Having as input parameters those described in table 1, the permutations that allow possible combinations for different variables are summarised in table 2. The "Necessary $CO_2$-rich solution inlet" values correspond to the minimum flow rates for the carbon dioxide-loaded gas-containing absorbent stream to ensure the minimal and necessary carbon dioxide supply to the gas diffusion electrode to sustain the combination of total current density and Faradaic efficiency (two-electron exchange reduction reaction). Due to the Joule heating, this gas-containing absorbent stream would heat up, and the maximal temperature increase of said stream is quantified in the column "ΔT $CO_2$-rich solution".

As it can be seen in Table 2, the gas-containing absorbent stream can heat up by almost 80 K for certain combinations of total current density, total cell voltage, heat loss, heat absorbed, and Faradaic efficiency for a two-electron exchange reduction reaction.

TABLE 2

Summary of the calculations of the temperature increase of a gas-containing absorbent stream (absorbed $CO_2$).

| Total Current Density [mA · cm$^{-2}$] | Total Cell Voltage [V] | Heat loss [%] | Heat absorbed CAT + AN [%] | FE (ERC, 2e$^-$) [%] | ΔT $CO_2$-rich solution [K] | Heat generation [W] | $CO_2$ consumption [kg $CO_2$ · h$^{-1}$] | Necessary $CO_2$-rich solution inlet [kg sol. · h$^{-1}$] |
|---|---|---|---|---|---|---|---|---|
| 200 | 3.0 | 10 | 50 | 50 | 23.6 | 600 | 0.821 | 26.7 |
| 200 | 3.0 | 10 | 50 | 90 | 13.1 | 600 | 1.478 | 48.0 |
| 200 | 3.0 | 10 | 25 | 50 | 35.5 | 600 | 0.821 | 26.7 |
| 200 | 3.0 | 10 | 25 | 90 | 19.7 | 600 | 1.478 | 48.0 |
| 200 | 3.0 | 25 | 50 | 50 | 59.1 | 1500 | 0.821 | 26.7 |
| 200 | 3.0 | 25 | 50 | 90 | 32.8 | 1500 | 1.478 | 48.0 |
| 200 | 3.0 | 25 | 50 | 50 | 59.1 | 1500 | 0.821 | 26.7 |
| 200 | 3.0 | 25 | 50 | 90 | 32.8 | 1500 | 1.478 | 48.0 |
| 200 | 4.0 | 10 | 50 | 50 | 31.5 | 800 | 0.821 | 26.7 |
| 200 | 4.0 | 10 | 50 | 90 | 17.5 | 800 | 1.478 | 48.0 |
| 200 | 4.0 | 10 | 25 | 50 | 47.3 | 800 | 0.821 | 26.7 |
| 200 | 4.0 | 10 | 25 | 90 | 26.3 | 800 | 1.478 | 48.0 |
| 200 | 4.0 | 25 | 50 | 50 | 78.8 | 2000 | 0.821 | 26.7 |
| 200 | 4.0 | 25 | 50 | 90 | 43.8 | 2000 | 1.478 | 48.0 |
| 200 | 4.0 | 25 | 50 | 50 | 78.8 | 2000 | 0.821 | 26.7 |
| 200 | 4.0 | 25 | 50 | 90 | 43.8 | 2000 | 1.478 | 48.0 |
| 500 | 3.0 | 10 | 50 | 50 | 23.6 | 1500 | 2.053 | 66.6 |
| 500 | 3.0 | 10 | 50 | 90 | 13.1 | 1500 | 3.695 | 119.9 |
| 500 | 3.0 | 10 | 25 | 50 | 35.5 | 1500 | 2.053 | 66.6 |
| 500 | 3.0 | 10 | 25 | 90 | 19.7 | 1500 | 3.695 | 119.9 |
| 500 | 3.0 | 25 | 50 | 50 | 59.1 | 3750 | 2.053 | 66.6 |
| 500 | 3.0 | 25 | 50 | 90 | 32.8 | 3750 | 3.695 | 119.9 |
| 500 | 3.0 | 25 | 50 | 50 | 59.1 | 3750 | 2.053 | 66.6 |
| 500 | 3.0 | 25 | 50 | 90 | 32.8 | 3750 | 3.695 | 119.9 |
| 500 | 4.0 | 10 | 50 | 50 | 31.5 | 2000 | 2.053 | 66.6 |
| 500 | 4.0 | 10 | 50 | 90 | 17.5 | 2000 | 3.695 | 119.9 |
| 500 | 4.0 | 10 | 25 | 50 | 47.3 | 2000 | 2.053 | 66.6 |
| 500 | 4.0 | 10 | 25 | 90 | 26.3 | 2000 | 3.695 | 119.9 |
| 500 | 4.0 | 25 | 50 | 50 | 78.8 | 5000 | 2.053 | 66.6 |
| 500 | 4.0 | 25 | 50 | 90 | 43.8 | 5000 | 3.695 | 119.9 |
| 500 | 4.0 | 25 | 50 | 50 | 78.8 | 5000 | 2.053 | 66.6 |
| 500 | 4.0 | 25 | 50 | 90 | 43.8 | 5000 | 3.695 | 119.9 |

Input variables are "Current Density", "Cell Voltage", "Heat loss" (corresponds to the fraction from the total energy input to the electrochemical system in the form of heat losses), "Heat absorbed CAT + AN" (fraction of heat losses absorbed by the anolyte and catholyte flows), and "FE(ERC, 2e$^-$)" (Faradaic efficiency for a $CO_2$ reduction reaction involving 2 electrons).

These calculations prove that the electrochemical cell described in this disclosure can generate enough heat to strip the necessary amount of gas from the gas-containing absorbent and sustain the electrochemical process that drives the Joule heating.

The invention claimed is:

1. A process of electrochemically converting a gas, in an electrochemical cell, comprising:

a) feeding a gas-containing absorbent into an electrochemical cell;

b) releasing a gas from the gas-containing absorbent by using thermal energy, wherein at least part of the thermal energy originates from Joule heat generated by the electrochemical cell, and c) converting the released gas to form a product, wherein the gas-containing absorbent is being fed into a compartment, the gas being released from the gas-containing absorbent inside the compartment and being transported through a gas permeable layer to a cathode compartment.

2. The process of claim 1, wherein the gas permeable layer is between the gas-containing absorbent inside the compartment and the cathode compartment.

3. The process of claim 1, wherein the gas permeable layer is permeable to carbon dioxide.

4. The process of claim 1, wherein the gas permeable layer comprises a non-porous, gas permeable layer.

5. The process of claim 1, wherein the gas permeable layer comprises a porous layer.

6. The process of claim 1, wherein a bipolar plate comprises the compartment.

7. The process of claim 6, wherein the bipolar plate comprises one or more selected from the group consisting of titanium, stainless steel, platinum, and graphite.

8. The process of claim 1, wherein the compartment is being heated up by the thermal energy to release the gas from the gas-containing absorbent.

* * * * *